US009990907B2

(12) United States Patent
McKenzie

(10) Patent No.: US 9,990,907 B2
(45) Date of Patent: Jun. 5, 2018

(54) STRING LOCKING TAILPIECE FOR FIXED BRIDGE MUSICAL INSTRUMENTS

(71) Applicant: Mathew Ryan McKenzie, Rogers, AR (US)

(72) Inventor: Mathew Ryan McKenzie, Rogers, AR (US)

( * ) Notice: Subject to any disclaimer, the term of this patent is extended or adjusted under 35 U.S.C. 154(b) by 0 days. days.

(21) Appl. No.: 15/223,149

(22) Filed: Jul. 29, 2016

(65) Prior Publication Data

US 2018/0033411 A1 Feb. 1, 2018

(51) Int. Cl.
*G10D 3/12* (2006.01)
*G10D 3/14* (2006.01)

(52) U.S. Cl.
CPC ..... *G10D 3/12* (2013.01); *G10D 3/14* (2013.01)

(58) Field of Classification Search
CPC ..... G10D 3/04; G10D 3/12
USPC ..... 84/298–302
See application file for complete search history.

(56) References Cited

U.S. PATENT DOCUMENTS

2005/0150348 A1* 7/2005 Ito ..... G10D 3/04 84/299
2007/0012158 A1* 1/2007 Kang ..... G10D 3/14 84/304
2008/0072735 A1* 3/2008 Kahler ..... G10D 3/146 84/313

FOREIGN PATENT DOCUMENTS

CN 203134340 U 8/2013

* cited by examiner

*Primary Examiner* — Kimberly Lockett
(74) *Attorney, Agent, or Firm* — Dunlap Bennett & Ludwig PLLC; Brendan E. Squire

(57) ABSTRACT

A string-locking tailpiece for fixed bridge musical instrument which allows for quick string changes. The device eliminates the conventional 3 wraps around the tuning peg. Tuning is stable because the ball end cannot slip thru the tuning peg hole. As well, it also drastically reduces the time necessary for restringing. The tailpiece receives a free end of the string after it has been strung through the tuning pegs and is clamped by a set screw within the tailpiece.

10 Claims, 3 Drawing Sheets

STRING LOCKING TAILPIECE FOR FIXED BRIDGE MUSICAL INSTRUMENTS

BACKGROUND OF THE INVENTION

The present invention relates to stringed instruments and, more particularly, to stringed instruments with a fixed bridge.

Replacing a string on a stringed instrument, such as a guitar can be a cumbersome time consuming process. The string will generally have a ball end which is secured in the tailpiece and a free end that is routed through the tuning post. Tuning gears on most stringed musical instruments typically have high winding ratios (20:1). Several string wraps around the tuning post are necessary for stable tuning. With only 3 wraps around the post that is 60 full tuning gear revolutions per string. This causes hand/wrist fatigue/injury while shortcuts lead to poor tuning stability. In addition, should the artist break a string during a performance, the delays in replacing a string according to conventional methods is unsatisfactory.

Other tailpieces in the art do not lock onto the free, non-ball end of the string. They only secure the ball end of the string.

As can be seen, there is a need for an improved tail piece string mount and stringing method for stringed instruments.

SUMMARY OF THE INVENTION

In one aspect of the present invention, a tailpiece for a stringed instrument includes: an elongate bar that is mounted transverse to a longitudinal orientation of a of string carried by the stringed instrument, an aperture extending between a front face and a back face of the tailpiece, a bore extending from a top surface of the tailpiece and intersecting with the aperture; and a set screw threadingly received within the bore. An arcuate indentation may be defined in a sidewall of the aperture opposite from the bore. The tailpiece may also include a rounded impinging end on the set screw that is received within the bore. The impinging end may be shaped to correspond with the arcuate indentation. The set screw may also include a tightening face oriented outwardly from the bore. The tightening face of the set screw is configured with one of a slotted, a Phillips, a hex, or a Torx opening. Alternatively, the set screw further has a thumb knob for tightening the set screw.

Other aspects of the invention include a method of stringing a musical instrument. The method includes mounting a tailpiece to a body of the musical instrument transverse to a longitudinal orientation of a of string to be carried by the musical instrument, an aperture extending between a front face and a back face of the tailpiece generally aligned with the longitudinal orientation of the string, a bore extending from a top surface of the tailpiece and intersecting with the aperture; and a set screw threadingly received within the bore. Next, the method includes threading a free end of the string through a peg aperture of a tuning peg attached to a head end of the musical instrument. The free end of the string is drawn through the peg aperture until a ball end of the string contacts the tuning peg. The free end of the string may be threaded through the tailpiece aperture.

Preferably, the free end is threaded from the front face to the back face of the tailpiece. The free end may be drawn through the aperture of the tailpiece to cinch the ball end of the string against the peg. The set screw may then tightened to impinge the string against a sidewall of the aperture opposite the bore. The string may then tuned be by rotating the tuning peg.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an improved tailpiece and method for mounting, replacing and tuning a string of a stringed instrument.

Figure 1:
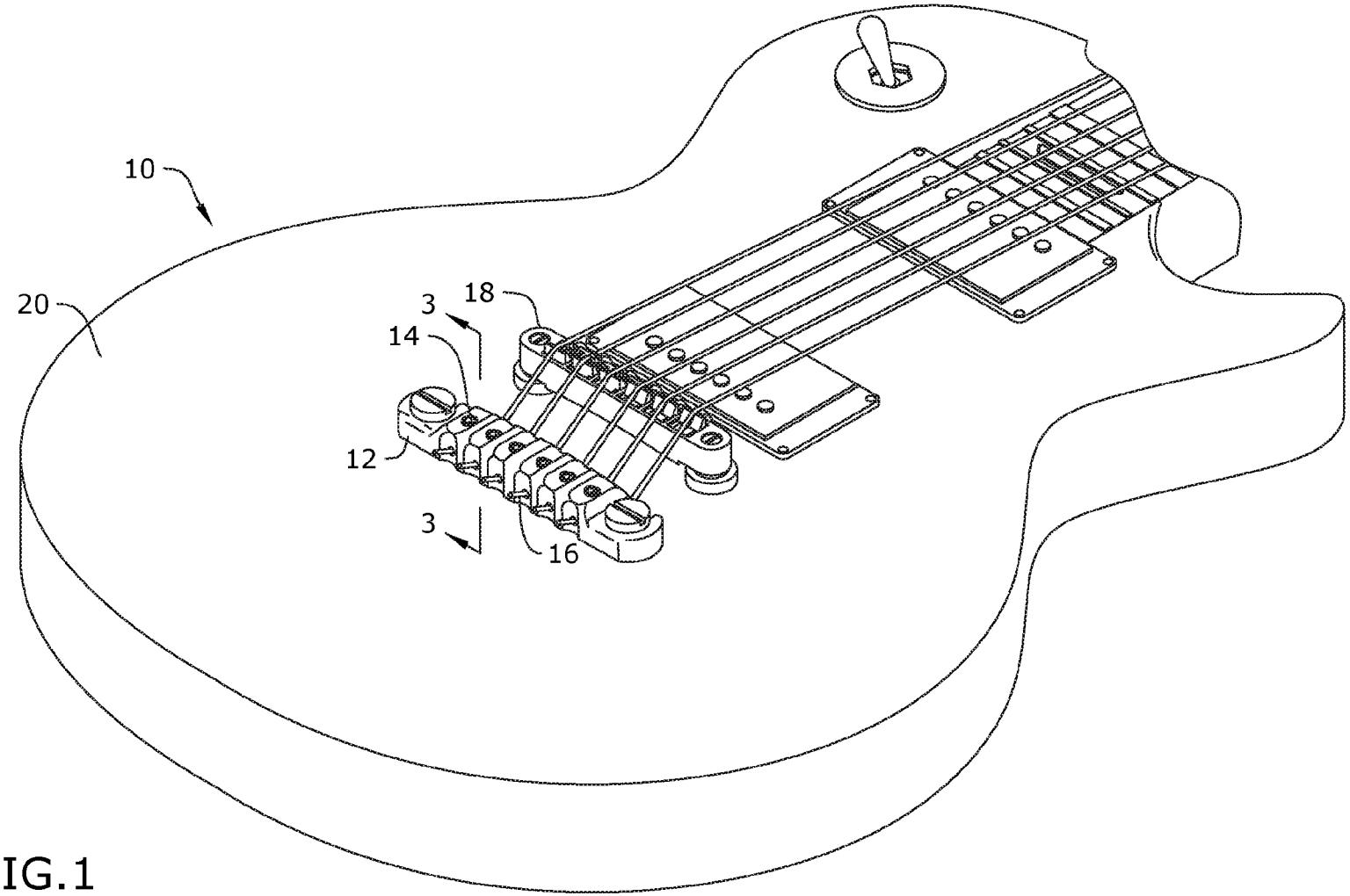
FIG. 1 is a perspective detail view of the invention.
Figure 4:
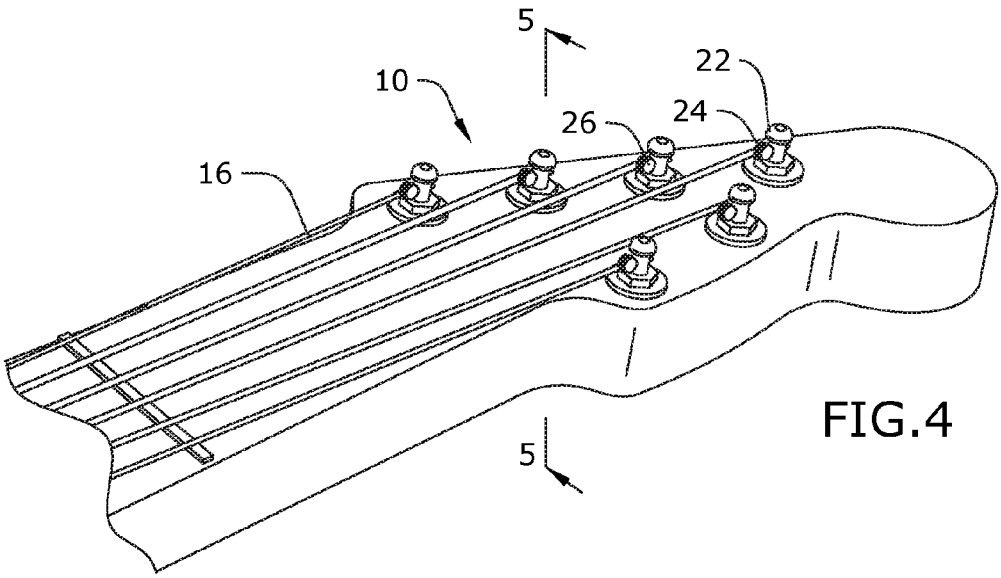
FIG. 4 is a perspective detail view of the invention.

Referring now to FIG. 1, a stringed instrument 10, such as a guitar, includes with a first end defining a body portion 20, a tailpiece 12 to which a first end of plurality of strings 16 are mounted, and a bridge 18 across which the strings 16 are suspended over the body 20 of the instrument 10. As seen in reference to FIG. 4, the instrument 10, has a second head end having a plurality of tuning pegs 22, to which a second end of the strings 16 are mounted. The tuning pegs 22 are utilized to tune the string 16 to a desired pitch, such as by winding or twisting the peg 22.

Figure 2:
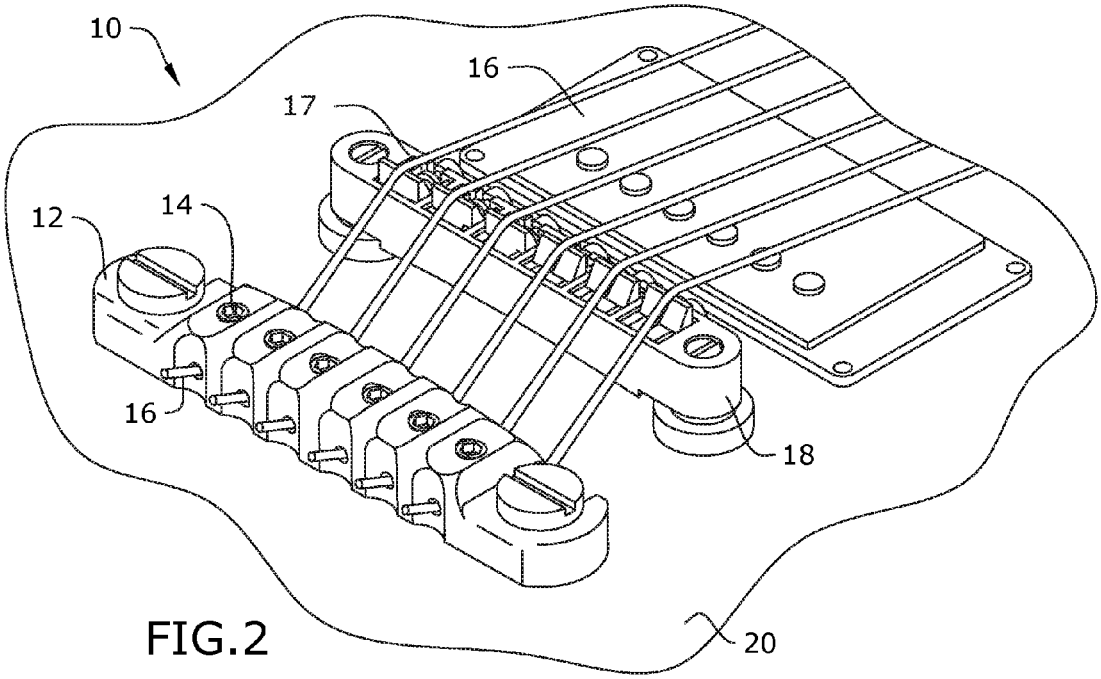
FIG. 2 is a perspective detail view of the invention.
Figure 3:
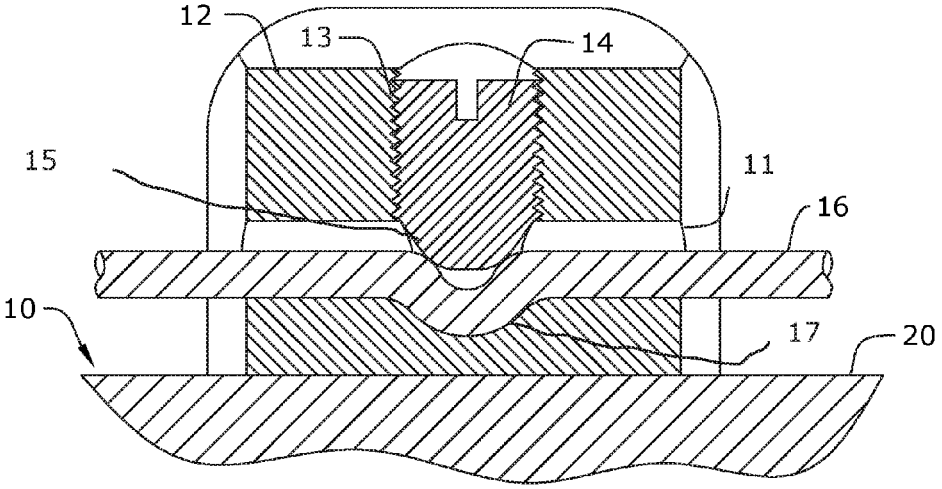
FIG. 3 is a section detail view of the invention taken along line 3-3 in FIG. 1.

As seen in the detail views of FIGS. 2 and 3, the tailpiece 12 comprises an elongate bar 12 that is mounted transverse to the direction of the strings 16 carried by the instrument 10. The tailpiece 12 has a plurality of apertures 11 extending between a front end and a back end of the tailpiece to receive a free end of the string 16 there through. A bore 16 extends from a top surface of the tailpiece 12 and intersects with the apertures 11. The bore 13 is configured to receive a set screw 14 therein. Preferably, the bore 13 will extend through the aperture 11 and define an arcuate indentation 17 on an opposite sidewall of the aperture 11 from the bore.

The strings 16 are threaded through the aperture 22 and the set screw may be tightened to impinge the string 16 against an opposite wall of the aperture 11. The screw 14 will preferably have a rounded impinging end 15 so as to avoid damage to the string 16 as it is impinged against the arcuate indentation 17. Preferably, a tightening end of the screw 14 is configured with a tightening face, such as a slotted, Phillips, hex, Torx, opening, or thumb knob for tightening the set screw 14 with a tool or manipulation by the user's fingers.

Figure 5:
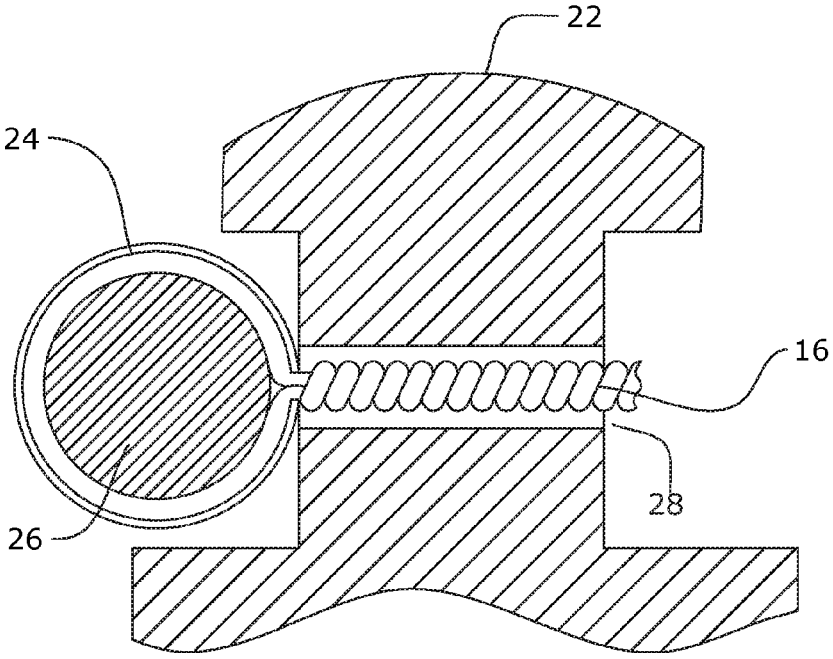
FIG. 5 is a section view of the invention taken along line 5-5 in FIG. 4.

With the locking tailpiece 12 of the present invention, speed and efficiency for the installation, replacement, and tuning of a stringed instrument 10 are greatly enhanced. According to an improved method of the present invention, as illustrated in reference to FIGS. 4 and 5, the free end of a string 16 is threaded through a peg aperture 28 defined laterally through the tuning peg 22 affixed to the head end of the musical instrument 10. The free end of the string 16 is drawn through the peg aperture 28 until a ball end of the string 16 is drawn in abutment with the aperture opening on the tuning peg 22. The ball end may be a solid ball formed to the end of the string 16 or may alternatively include a cylindrical member around which the string 16 is wrapped before being tightly wrapped around itself to cinch the cylindrical member 26.

Referring back to FIGS. 2 and 3, the free end of the string is then routed through the tailpiece 12 aperture 11 and drawn snugly while ensuring the string is properly routed over a supporting notch 17 on the bridge 18. The set screw 14 may then be tightened to secure the free end of the string in the locking tailpiece 12. Excess string 16, may be clipped off proximal to the tailpiece 12 and discarded.

The stringed instrument may then be tuned by manipulation of the tuning peg 22. With the ball end in contact with the tuning peg, the string 16 is able to be tightened quickly and easily, without the user having to ensure that the free end is overlapped with the string around the tuning peg 22, as is required in conventional stringing methods to avoid slippage of the free end of the string 16 during the tightening and tuning sequence. The method also eliminates the excessive turning of the tuning peg required of conventional tuning techniques.

It should be understood, of course, that the foregoing relates to exemplary embodiments of the invention and that modifications may be made without departing from the spirit and scope of the invention as set forth in the following claims.

What is claimed is:

1. A tailpiece for a stringed instrument, comprising:

an elongate bar that is mounted transverse to a longitudinal orientation of a of string carried by the stringed instrument, an aperture extending between a front face and a back face of the tailpiece, a bore extending from a top surface of the tailpiece and intersecting with the aperture;

a set screw threadingly received within the bore; and an arcuate indentation defined in a sidewall of the aperture opposite from the bore.

2. The tailpiece of claim 1, further comprising:

a rounded impinging end on the set screw received within the bore.

3. The tailpiece of claim 2, wherein the impinging end is shaped to correspond with the arcuate indentation.

4. The tailpiece of claim 3, further comprising:

a tightening face on the set screw oriented outwardly from the bore.

5. The tailpiece of claim 4, wherein the tightening face of the set screw is configured with one of a slotted, a Phillips, a hex, or a Torx opening.

6. The tailpiece of claim 3, wherein the set screw further comprises a thumb knob for tightening the set screw.

7. A tailpiece for a stringed instrument, comprising:

an elongate bar configured to be mounted transverse to a longitudinal orientation of a of string carried by the stringed instrument;

an aperture extending between a front face and a back face of the tailpiece and configured to receive a string of the stringed instrument;

a bore extending from a top surface of the tailpiece and intersecting with the aperture, the bore configured to threadingly receive a set screw within the bore, such that when tightened, the set screw impinges the string against an opposite sidewall of the aperture; and an arcuate indentation defined in a sidewall of the aperture opposite from the bore.

8. The tailpiece of claim 7, further comprising:

a set screw received within the bore, the set screw having an arcuate impinging end.

9. The tailpiece of claim 8, wherein the impinging end is shaped to correspond with the arcuate indentation.

10. The tailpiece of claim 7, further comprising:

a tightening end on the set screw oriented outwardly from the bore, wherein the tightening end of the set screw is configured with one of a group consisting of a slot, a Phillips opening, a hex, a Torx, or a thumb knob.

* * * * *